US011764492B2

(12) United States Patent
Yamaguchi et al.

(10) Patent No.: US 11,764,492 B2
(45) Date of Patent: Sep. 19, 2023

(54) CONNECTION STRUCTURE OF PRESS-CLAMPING TERMINAL AND CABLE

(71) Applicant: Yazaki Corporation, Tokyo (JP)

(72) Inventors: Yasuhiro Yamaguchi, Shizuoka (JP); Hideki Mizuno, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 36 days.

(21) Appl. No.: 17/591,187

(22) Filed: Feb. 2, 2022

(65) Prior Publication Data

US 2022/0247094 A1 Aug. 4, 2022

(30) Foreign Application Priority Data

Feb. 3, 2021 (JP) ..... 2021-015544

(51) Int. Cl.
*H01R 4/18* (2006.01)
*H01B 7/18* (2006.01)
*H01R 13/52* (2006.01)

(52) U.S. Cl.
CPC ..... *H01R 4/185* (2013.01); *H01B 7/18* (2013.01); *H01R 13/5202* (2013.01)

(58) Field of Classification Search
CPC ..... H01R 4/185; H01R 13/5202; H01B 7/18
USPC ..... 439/397
See application file for complete search history.

(56) References Cited

U.S. PATENT DOCUMENTS

| | | | | |
|---|---|---|---|---|
| 9,397,411 | B2 * | 7/2016 | Ito | H01R 9/0518 |
| 2013/0252488 | A1 | 9/2013 | Ito et al. | |
| 2014/0311797 | A1 | 10/2014 | Numata et al. | |
| 2015/0372399 | A1 | 12/2015 | Ito et al. | |
| 2019/0372245 | A1 * | 12/2019 | Sato | H01R 4/2495 |

FOREIGN PATENT DOCUMENTS

| | | | | |
|---|---|---|---|---|
| DE | 102013204720 | A1 * | 9/2013 | H01R 4/188 |
| DE | 102013204720 | A1 | 9/2013 | |
| DE | 202015008963 | U1 * | 6/2016 | |
| EP | 3579340 | A1 * | 12/2019 | H01R 11/11 |
| EP | 3579341 | A1 * | 12/2019 | H01R 4/184 |
| EP | 3579341 | A1 | 12/2019 | |
| JP | 2009-295352 | A | 12/2009 | |
| JP | 2010-225529 | A | 10/2010 | |
| JP | 2019-16535 | A | 1/2019 | |
| JP | 2019016535 | A * | 1/2019 | |
| WO | 2017/115710 | A1 | 7/2017 | |

* cited by examiner

*Primary Examiner* — Peter G Leigh
(74) *Attorney, Agent, or Firm* — Sughrue Mion, PLLC

(57) ABSTRACT

A connection structure of a press-clamping terminal and a cable has: a cable that has a core wire and an insulation sheath that covers the core wire; a press-clamping terminal that is press-clamped to the core wire exposed from the insulation sheath at a terminal of the cable; and a cut portion that has a cross section formed in a semicircular shape and is formed in a press-clamping direction in the exposed core wire.

1 Claim, 3 Drawing Sheets

CONNECTION STRUCTURE OF PRESS-CLAMPING TERMINAL AND CABLE

CROSS-REFERENCE TO RELATED APPLICATIONS

The present application is based on, and claims priority from Japanese Patent Application No. 2021-015544, filed on Feb. 3, 2021, the entire contents of which are incorporated herein by reference.

TECHNICAL FIELD

The present disclosure relates to a connection structure of a press-clamping terminal and a cable, in which a core wire of a cable is crimped and connected with crimp pieces of a press-clamping terminal.

BACKGROUND

JP 2009-295352 A discloses a press-clamping terminal having a pair of core wire barrels that are crimped and press-clamped to a core wire that is made of a plurality of element wires and is exposed from an insulation sheath at a terminal of a cable.

SUMMARY

The pair of core wire barrels of the press-clamping terminal are formed to be inclined such that the amount of projection increases from a front end on the electric contact portion side toward a rear end. Therefore, the compression load of the core wire barrels applied to a core wire can be reduced more on the rear end side than the front end on the electric contact portion side of the core wire barrels.

However, in a connection structure of the press-clamping terminal and a cable, the core wire barrels are shaped such that the compression load applied to a core wire by the core wire barrels is more reduced on the rear end side than the front end on the electric contact portion side. Therefore, the structure from the core wire barrels to the end of the cable is increased in size.

An object of the present disclosure is to provide a connection structure of a press-clamping terminal and a cable that can, when a core wire of a cable and a press-clamping terminal are press-clamped and connected, suppress deformation of the end of the cable and reduce the size of the area around the press-clamping.

A connection structure of a press-clamping terminal and a cable according to an embodiment includes a cable that includes a core wire and an insulation sheath that covers the core wire, a press-clamping terminal that is press-clamped to the core wire exposed from the insulation sheath at a terminal of the cable, and a cut portion that is formed in a press-clamping direction in the exposed core wire.

The cut portion of the exposed core wire may be formed by cutting one side in the press-clamping direction.

The cut portion of the exposed core wire may be formed to include a cross section formed in a semicircular shape.

A crimp piece of the press-clamping terminal may be crimped and press-clamped to the cut portion of the exposed core wire.

According to the above configuration, it is possible to provide a connection structure of a press-clamping terminal and a cable that can, when a core wire of a cable and a press-clamping terminal are press-clamped and connected, suppress deformation of the end of the cable and reduce the size of the area around the press-clamping.

DETAILED DESCRIPTION

Hereinafter, a connection structure of a press-clamping terminal and a cable according to an embodiment of the present disclosure will be described in detail with reference to the drawings.

Figure 1:
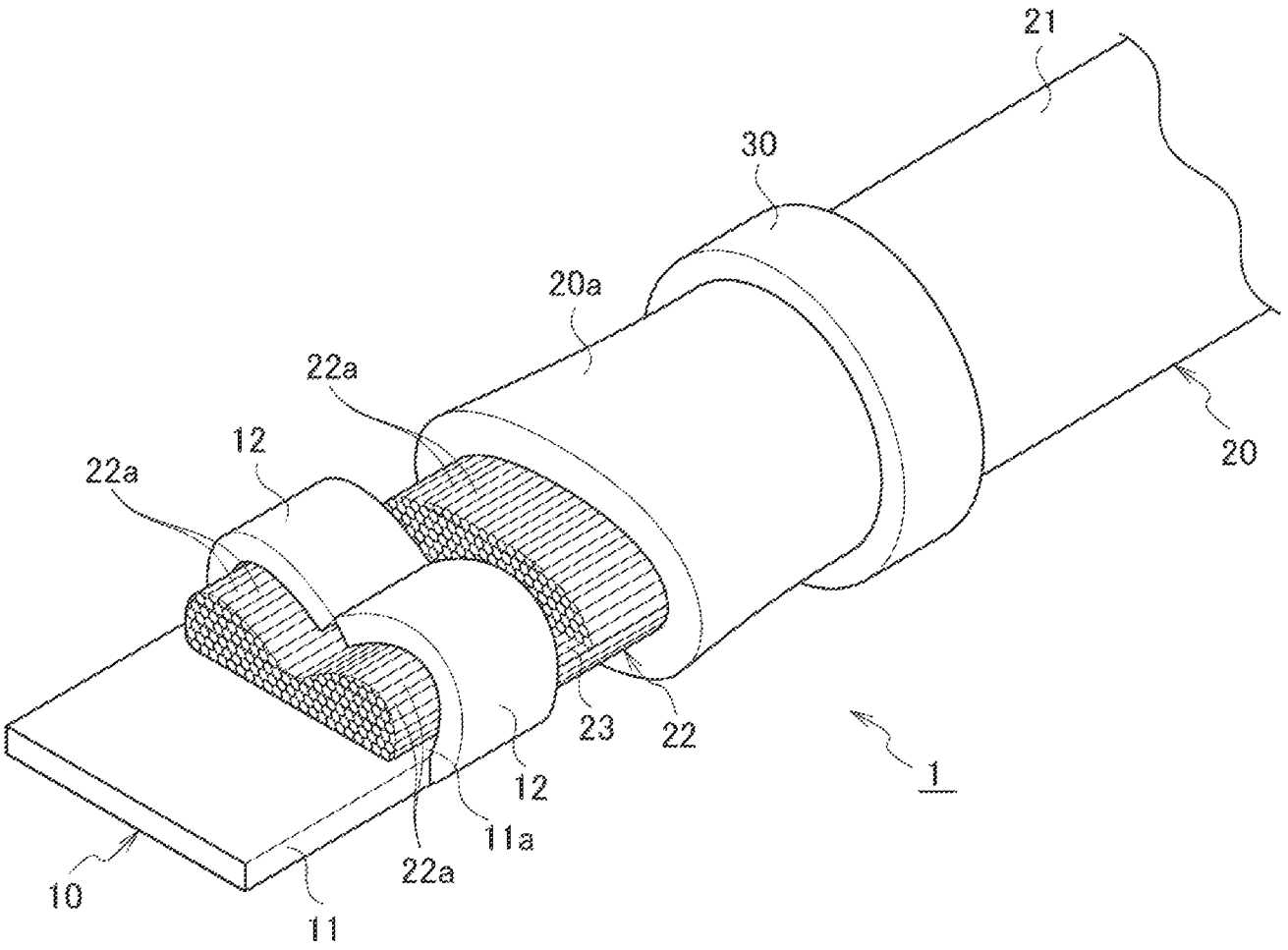
FIG. 1 is a perspective view showing an example of a connection structure of a press-clamping terminal and a cable according to an embodiment.
Figure 2:
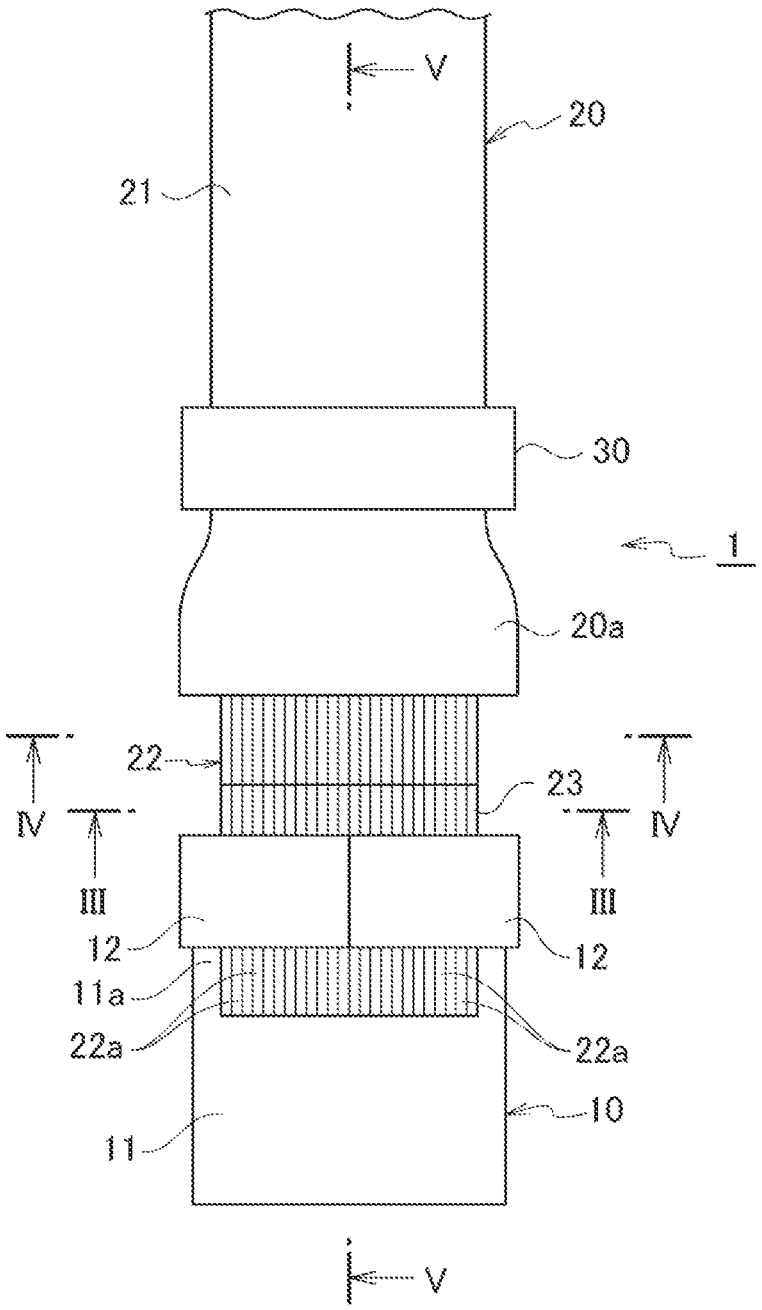
FIG. 2 is a plan view of a connection structure of a press-clamping terminal and a cable.
Figure 3:
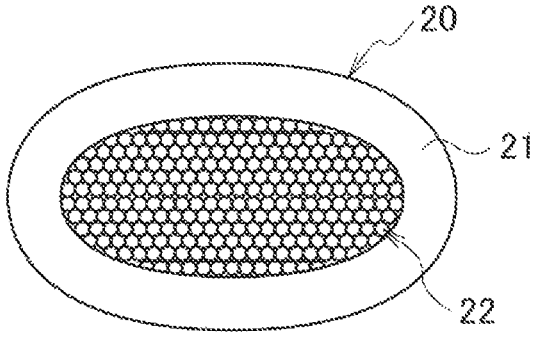
FIG. 3 is a cross-sectional view taken along line in FIG. 2.
Figure 4:
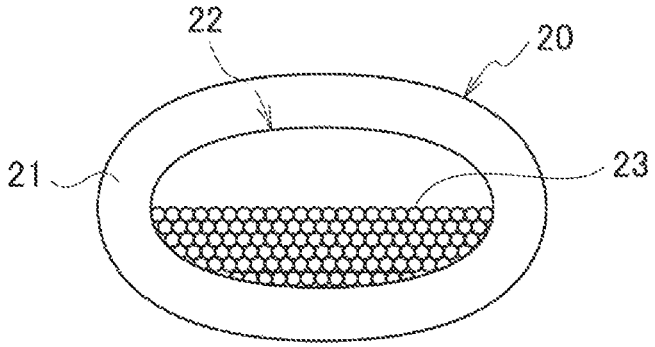
FIG. 4 is a cross-sectional view taken along line IV-IV in FIG. 2.
Figure 5:
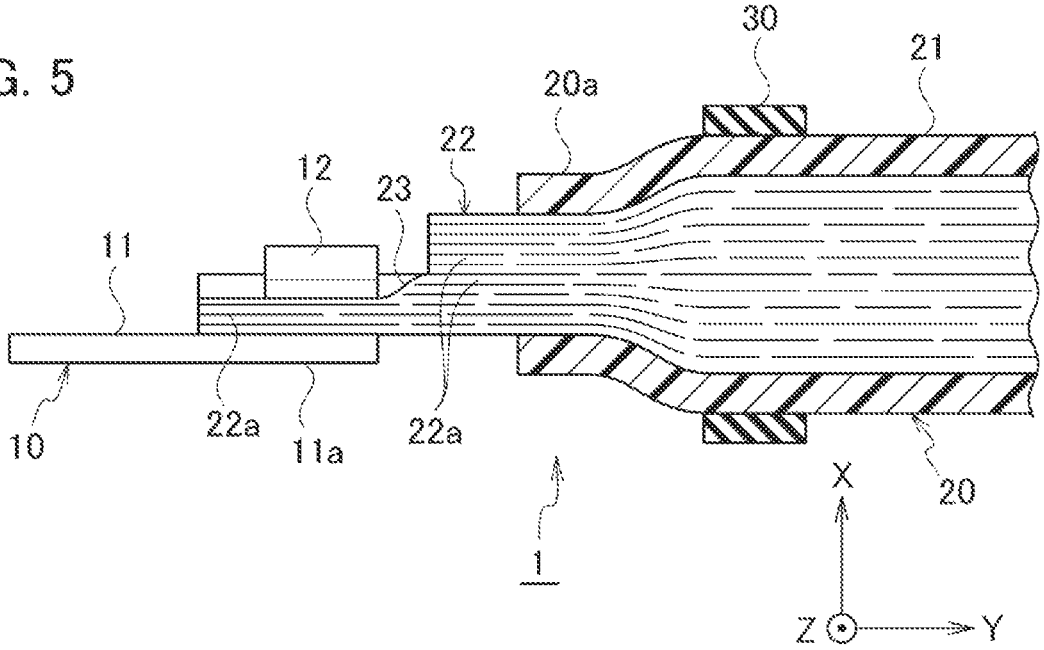
FIG. 5 is a cross-sectional view taken along line V-V in FIG. 2.

As shown in FIGS. 1, 2, and 5, a connection structure 1 of a press-clamping terminal 10 and a cable 20 includes: the cable 20, which has a core wire 22 and an insulation sheath 21 that covers the core wire 22; the core wire 22, which is exposed from the insulation sheath 21 at an end 20*a* of the cable 20; and the press-clamping terminal 10, which is press-clamped to the exposed core wire 22. In FIG. 5, reference character X denotes the press-clamping direction (vertical direction), reference character Y denotes the axial direction (horizontal direction) of the core wire 22, and reference character Z denotes the longitudinal direction (width direction).

As shown in FIGS. 1 and 5, the press-clamping terminal 10 is formed by press processing a conductive metal plate such as copper or a copper alloy. The press-clamping terminal 10 includes a rectangular plate-shaped electrical connection portion 11, and a pair of crimp pieces 12 and 12 that stand upward in the press-clamping direction from both sides of a proximal end 11*a* of the electrical connection portion 11 in the longitudinal direction. The pair of crimp pieces 12 and 12 of the press-clamping terminal 10 are crimped to a cut portion 23 side of the core wire 22 exposed from the insulation sheath 21 at the end 20*a* of the cable 20, through an anvil and a crimper which are not shown. Accordingly, the pair of crimp pieces 12 and 12 press-clamp and connect the core wire 22.

As shown in FIGS. 1, 2 and 5, the end 20*a* of the cable 20 is formed by peeling off the insulation sheath 21 at a terminal of the cable 20, and the core wire 22 is exposed. The core wire 22 is a conductor composed of a plurality of element wires 22*a*, and is formed of a conductive material such as copper or a copper alloy, or aluminum or an aluminum alloy.

The core wire 22 exposed from the insulation sheath 21 of the cable 20 has the cut portion 23 in the press-clamping direction. The cut portion 23 has a cross section which is formed in a semicircular shape by cutting one side in the press-clamping direction (the one side is the side opposite to the side facing the press-clamping terminal 10 when the core wire 22 is press-clamped and connected to the press-clamping terminal 10, and is the upper side in the press-clamping direction in FIG. 5). By forming the cut portion 23 in the core wire 22 of the cable 20, the height (the thickness) of the core wire 22 in the press-clamping direction is reduced. As shown in FIGS. 1, 2, and 5, the press-clamping terminal 10 and the core wire 22 of the cable 20 are press-clamped by means of crimping performed by the pair of crimp pieces 12 and 12 of the press-clamping terminal 10. An annular waterproof plug 30 made of rubber is fitted into a position on the end 20*a* side of the cable 20 press-clamped and connected to the press-clamping terminal 10.

As described above, according to the connection structure 1 of the press-clamping terminal 10 and the cable 20 of an embodiment, the cut portion 23 is formed by cutting one side, in the press-clamping direction, of the core wire 22 exposed from the insulation sheath 21 of the cable 20. The diameter (thickness) of the core wire 22 in the press-clamping direction is reduced in size, and in this state the core wire 22 is press-clamped by the crimp pieces 12 of the press-clamping terminal 10. By press-clamping and connecting only some of the element wires 22*a* constituting the core wire 22 to the press-clamping terminal 10, flattening (deformation) of the end 20*a* of the cable 22 can be suppressed when the exposed core wire 20 of the cable 20 is press-clamped and connected to the press-clamping terminal 10, and the waterproof plug 30 can be fitted more into a position on the end 20*a* side of the cable 20.

As described above, the flattening of the end 20*a* of the cable 20 can be suppressed when the core wire 22 exposed from the end 20*a* of the cable 20 and the press-clamping terminal 10 are press-clamped and connected. Therefore, the area around the press-clamping between the end 20*a* of the cable 20 including the waterproof plug 30 and the press-clamping terminal 10 can be made smaller.

Further, by cutting one side in the press-clamping direction, the cut portion 23 of the core wire 22 is formed to have a cross section formed in a semicircular shape. Accordingly, when the crimp pieces 12 of the press-clamping terminal 10 and the core wire 22 of the cable 20 are crimped, crimping and connecting can be performed easily.

Although the present embodiment has been described above, the present embodiment is not limited to the above description, and various modifications can be made within the scope of the gist of the present embodiment.

That is, according to the above embodiment, a core wire exposed from an insulation sheath of a cable is cut into a semicircular shape to form a cut portion. However, it is also possible to form a cut portion having a diameter smaller than that of the core wire by cutting a plurality of element wires located at the outer circumference among a plurality of element wires constituting the core wire.

Further, according to the embodiment, a waterproof plug is fitted into a position on an end side of a cable as a rubber component. However, the rubber component is not limited to being a waterproof plug and may be a protective component, a holding component, or the like.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A connection structure of a press-clamping terminal and a cable comprising:

a cable that includes a core wire and an insulation sheath that covers the core wire;

a press-clamping terminal that is press-clamped to the core wire exposed from the insulation sheath at a terminal of the cable; and a cut portion that is formed in a press-clamping direction in the exposed core wire, by cutting a plurality of element wires located at the outer circumference among a plurality of element wires constituting the core wire, the cut portion having a diameter smaller than that of the core wire is formed, wherein only some of the element wires constituting the core wire are crimped and connected to the crimping terminal.

* * * * *